US006537628B1

(12) United States Patent
Bruewer et al.

(10) Patent No.: US 6,537,628 B1
(45) Date of Patent: Mar. 25, 2003

(54) REINFORCED ELASTOMERIC BAG FOR USE WITH ELECTRIC SUBMERGIBLE MOTOR PROTECTORS

(76) Inventors: Timothy B. Bruewer, 2622 Manor Ter., Lawrence, KS (US) 66046; Edine M. Heinig, 525 Lawrence Ave., Lawrence, KS (US) 66049; Steve C. Kennedy, 1316 Ridgewood, Bartlesville, OK (US) 74006

( * ) Notice: Subject to any disclaimer, the term of this patent is extended or adjusted under 35 U.S.C. 154(b) by 0 days.

(21) Appl. No.: 08/755,275

(22) Filed: Nov. 22, 1996

(51) Int. Cl.[7] ..... B32B 1/08

(52) U.S. Cl. ..... 428/36.4; 428/35.4; 428/35.7; 428/36.1; 428/36.3; 525/178

(58) Field of Search ..... 428/35.4, 35.7, 428/36.1, 36.4; 525/178

(56) References Cited

U.S. PATENT DOCUMENTS

| | | | | |
|---|---|---|---|---|
| 2,740,908 A | | 4/1956 | Dochterman | |
| 3,209,061 A | | 9/1965 | Mier et al. | |
| 3,369,137 A | | 2/1968 | Sanger | |
| 3,427,392 A | | 2/1969 | Plummer | |
| 3,948,288 A | | 4/1976 | Mayer | |
| 4,585,400 A | | 4/1986 | Miller | |
| 4,769,261 A | * | 9/1988 | Hazelton et al. | 428/35 |
| 4,936,383 A | | 6/1990 | Towner et al. | |
| 5,108,807 A | * | 4/1992 | Tucker | 428/35.2 |
| 5,134,328 A | | 7/1992 | Johnatakis et al. | |
| 5,296,537 A | * | 3/1994 | La Fleur et al. | 525/57 |
| 5,404,061 A | | 4/1995 | Parmeter | |
| 5,601,889 A | * | 2/1997 | Chundury et al. | 428/34.3 |
| 5,681,627 A | * | 10/1997 | Mueller | 428/35.2 |

* cited by examiner

*Primary Examiner*—Helen L. Pezzuto
(74) *Attorney, Agent, or Firm*—Jeffrey E. Griffin; Brigitte Jeffrey

(57) ABSTRACT

A reinforced elastomeric bag for use within an electric submergible motor protector comprises a bag body formed from elastomeric material, such as fluoride co- and ter-polymers, butadiene copolymers, ethylene propylene diene methylene-based polymers, and combinations thereof; and a reinforcing material, such as tetrafluroethylene, aromatic p-polyamides, aromatic o,m-polyamides, fiberglass, ferrous metal, nonferrous metal, and combinations thereof. The reinforcing material is in the form of particles, threads and/or a weave that is dispersed within, bonded to or layered within the elastomeric material in a manner to improve the tear resistance of the bag at elevated temperatures encountered within wellbores.

18 Claims, 2 Drawing Sheets

16
12
-P-
-Pr.-
32
26
24
22
-20-
-20-
28
24
30
26
10
-M-
18
14

REINFORCED ELASTOMERIC BAG FOR USE WITH ELECTRIC SUBMERGIBLE MOTOR PROTECTORS

BACKGROUND OF THE INVENTION

1. Field of the Invention

The present invention relates to oil-filled protectors for use with electric motors and, more particularly, for use with electric submergible motors to be suspended within wellbores.

2. Description of Related Art

Electric submergible pumps are widely used throughout the world for recovering subterranean fluids to the earth's surface. For the long term successful operation of such submergible pumping systems, the electric motor must be supplied with uncontaminated cooling motor oil. This cooling oil is partially contained within one or more elastomeric bags within a motor protector. Unfortunately, in wellbore environments with elevated temperatures, such as greater than about 300 degrees F., conventional motor protector bags rapidly deteriorate and split so that the motor oil will become contaminated by wellbore fluids. This contamination can directly lead to shortened operational life, which in turn will cause the premature shutting-in of the well, and the costly removal and repair of the submergible pumping system.

Specifically, the elastomeric motor protector bags are generally cylindrical in shape and are sealed within an oil filled housing. The bags are filled with oil at the time of installation to an expanded state. With the rise of temperature caused by the immersion in the wellbore, as well as the thermal expansion caused by the operation of the electric motor, the bags tend to slightly expand even more. When the electric motor is turned off, the cooling oil cools and contracts. This contraction allows the motor protector bag to deflate. The repeated expanding and contraction of the elastomeric bag can cause splitting or cracks in the bag under certain conditions.

The elastomer typically used for the elastomeric bags is a saturated nitrile. This material exhibits a satisfactory combination of elasticity and tear resistance at operating temperatures up to about 300 degrees F. However, above about 300 degrees F., the saturated nitrile becomes brittle and looses its elastomeric properties. Other materials can be used to produce an elastomeric bag with satisfactory elasticity up to about 400 degrees F., such as fluorine containing co- and ter-polymers and ethylene propylene diene methylene-based terpolymers. These materials, however, do not have the needed tear resistance at the temperatures above about 300 degrees F. to withstand the repeated expansion and contraction.

There is a need for an improved elastomeric bag for use within an oil-filled electric motor protector that exhibits satisfactory elasticity and tear resistance in a wellbore environment and at temperatures above about 300 degrees F.

SUMMARY OF THE INVENTION

The present invention has been contemplated to overcome the foregoing deficiencies and meet the above described needs. Specifically, the present invention is a reinforced elastomteric bag for use within an oil-filled electric motor protector with the bag body formed from elastomeric material selected from the group consisting essentially of: tetrafluoroethylene-propylene copolymer, vinylidene fluoride hexafluoropropylene copolymer, virtually saturated acrylonitrile-butadiene copolymer, vinylidene fluoride-perfluoromethylvinylether-tetrafluoroethylene terpolymer, vinylidene fluoride hexafluoropropylene tetrafluoroethylene terpolymer, ethylene propylene diene methylene-based polymers, and combinations thereof; and a reinforcing material selected from the group consisting essentially of: tetrafluroethylene, aromatic p-polyamides, aromatic o,m-polyamides, fiberglass, ferrous metal, nonferrous metal, and combinations thereof. The reinforcing material is in the form of particles, threads and/or a weave that is dispersed within, bonded to or layered within the elastomeric material in a manner to improve the tear resistance of the bag at elevated temperatures.

DETAILED DESCRIPTION OF THE PREFERRED EMBODIMENTS

For the purposes of the following discussion it will be assumed that the elastomeric bag of the present invention is used within an oil-filled electric motor protector of the type used with submergible electric motors to be suspended within wellbores. However, it should be understood that the present invention can be used within any other type of downhole or surface motor, pump, turbine or other industrial machine that requires the use of an elastomeric body with improved tear resistance at temperatures greater than about 300 degrees F.

Figure 1:
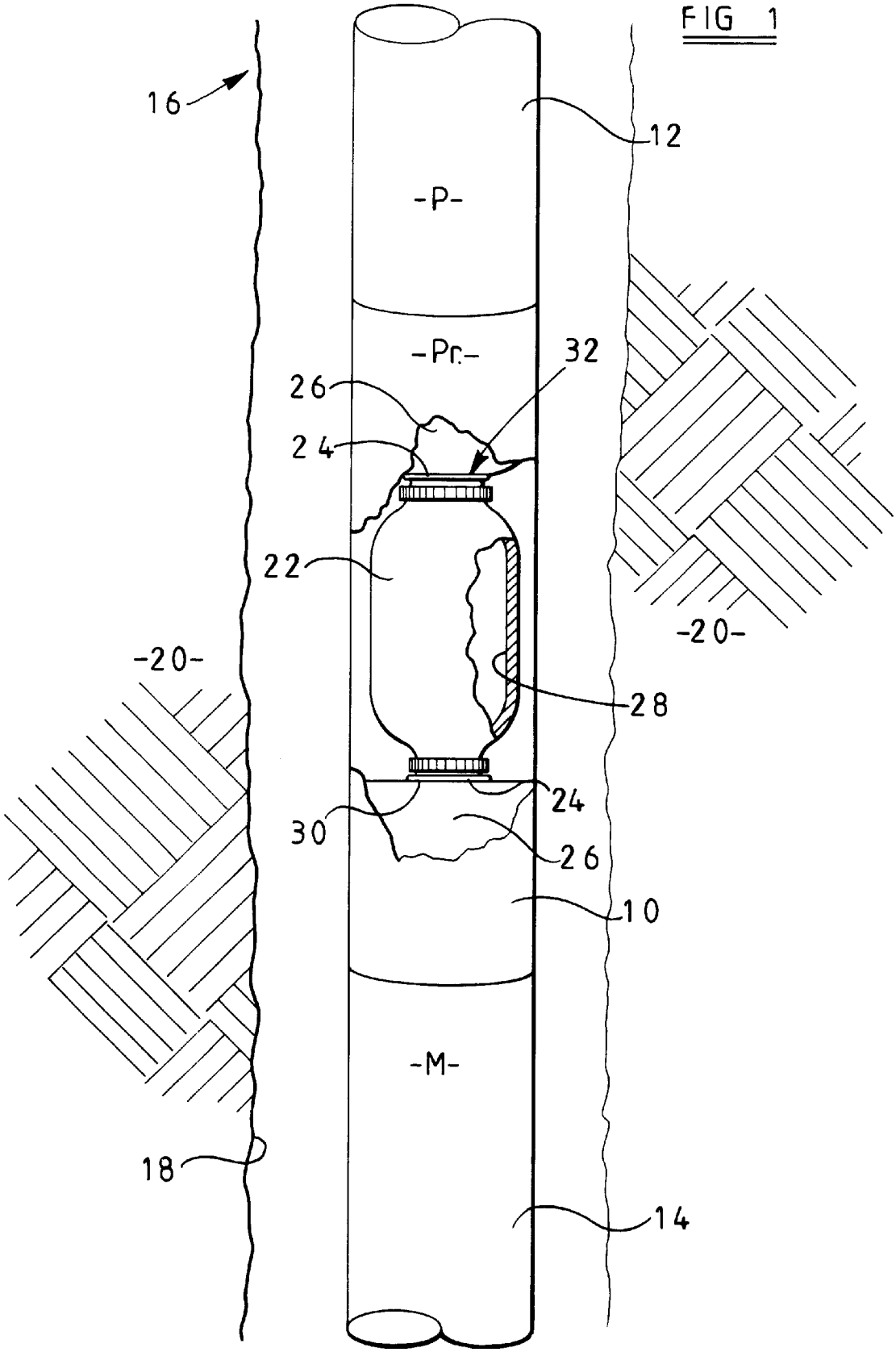
FIG. 1 is a vertical partial cut-away view of an oil-filled electric motor protector, shown operationally interconnected between a pump and an electric motor, and suspended within a subterranean wellbore.

As has been briefly described above the present invention is a reinforced elastomeric bag for use within an oil-filled electric motor protector. Electric motor protectors are well known to those skilled in the art, and they provide the capability for thermal expansion of the electric motor's cooling oil, they provide isolation of the cooling oil from wellbore fluids, and they usually contain thrust bearings to absorb the axial loading of the pump that is connected thereto. FIG. 1 illustrates one preferred embodiment of a motor protector 10 of the present invention connected, in any well known manner, between a pump 12 and an electric motor 14. The arrangement of the motor protector 10, the pump 12 and the electric motor 14 is commonly referred to as an electric submergible pumping system or "esp" 16. FIG. 1 shows the esp 16 suspended within a wellbore 18 that penetrates one or more earthen formations 20.

An interior of the motor protector 10 contains one or more generally cylindrical elastomeric bags 22, which are clamped on each end by annular brackets or rings 24 across spaced inner housings 26. An interior 28 of each bag 22 is filled with cooling oil that is conveyed to and from the electric motor 14 through internal passages (not shown) in the protector 10 and the motor 14, as is well known to those skilled in the art. The elastomeric bag 22 is preferably formed as a single continuous body, without a seam or weld, and has a thickened portion or bead 30 adjacent each mouth or end opening 32.

The bag body is preferably formed primarily from an elastomeric material that provides desired elasticity at temperatures above about 300 degrees F. Suitable elastomeric materials include tetrafluoroethylene-propylene copolymers, vinylidene fluoride hexafluoropropylene copolymers, virtually saturated acrylonitrile-butadiene copolymers, vinylidene fluoride-perfluoromethylvinylether-tetrafluoroethylene terpolymers, vinylidene fluoride hexafluoropropylene tetrafluoroethylene terpolymers, ethylene propylene diene methylene-based polymers, and combinations thereof. One or more bonded layers of such material(s) can be used as is desired.

It has been found that the tear resistance of an elastomeric bag formed simply with one or more of the above materials may not be great enough to withstand repeated expansion and contractions without ripping or tearing. To increase the tear resistance of the elastomeric material one or more reinforcing materials is preferably added. Reinforcing materials being added to elastomeric materials is well known in the rubber industry, especially with tires, conveyor belts, fan belts, and the like. However, the inventors hereof found that conventional reinforcing agents and methods of manufacture may have dramatically increased the tear resistance of the elastomeric material, but the elasticity of the resulting bag was decreased to the point of being nonuse able within a motor protector and/or within a wellbore environment. Therefore, the inventors hereof tested various reinforcing materials and methods to find suitable combinations.

The inventors found that suitable reinforcing materials included particles, threads and/or weaves of tetrafluroethylene, aromatic p-polyamides, aromatic o,m-polyamides, fiberglass, ferrous metal, nonferrous metal, and combinations thereof. The reinforcing material, in the form of the particles, threads and/or weave, are dispersed within, bonded to or layered within the elastomeric material in manners to improve the tear resistance of the bag 22 at elevated temperatures, such as at temperatures of greater than about 300 degrees F.

Figure 2:
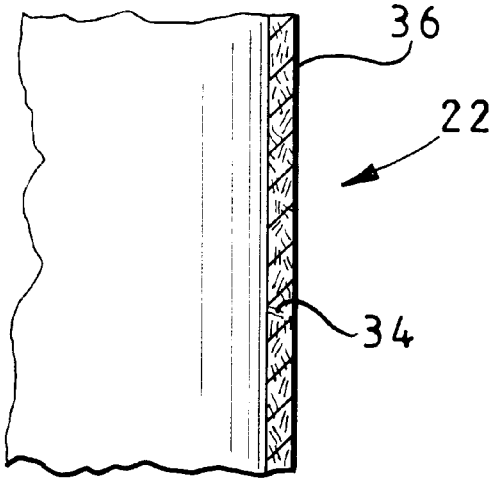
FIGS. 2–5 are vertical sectional views of alternate preferred embodiments of an elastomeric bag for use within an oil-filled electric motor protector.

One preferred method of manufacture is to mechanically blend the particles and threads of reinforcing material with the elastomeric material to form a continuous phase. Such mixing can be accomplished using a high intensity internal mixer or a two roll mill, as is well known to those skilled in the art. Once blended, the resulting material mixture is injected or compression molded about a form mandrel, and then vulcanized. Once vulcanized, the finished bag 22 is inflated and removed from the form mandrel, and dressed and packaged. A cross-section view of a bag 22 formed by the above process is shown in FIG. 2, with particles or threads 34 of the reinforcing material being dispersed within elastomeric material 36.

Figure 3:
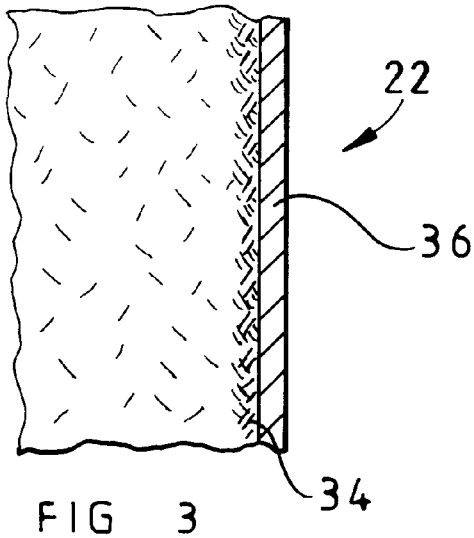

An alternate preferred embodiment of the present invention is shown in FIG. 3 where the particles or threads 34 of the reinforcing material are sprayed or applied by hand and bonded or glued onto an internal surface of the bag 22. This application of the reinforcing material can be accomplished by coating the form mandrel, applying the elastomeric material, and then vulcanizing the bag 22, or after the bag 22 has been vulcanized, as is desired.

Figure 4:
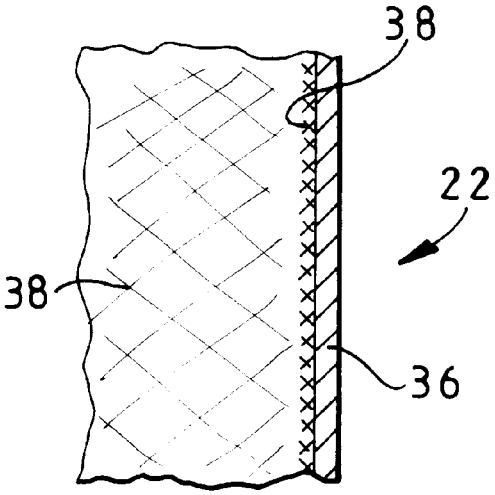

An alternate preferred embodiment of the present invention is shown in FIG. 4 and is made by wrapping the form mandrel with a relatively loose weave 38 formed from the reinforcing material. The elastomeric material 36 is then applied to the weave, molded and vulcanized. Alternatively, the weave 38 can be applied after the vulcanization by hand and bonded or glued onto an internal surface of the bag 22.

Figure 5:
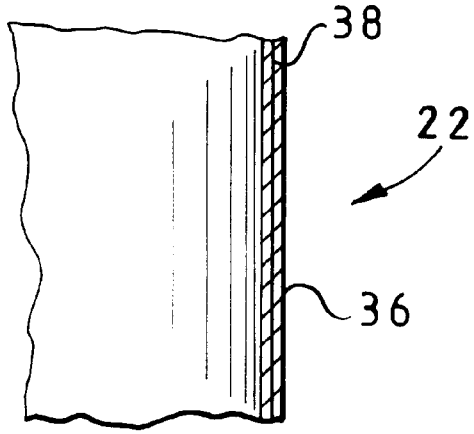

Another alternate preferred embodiment of the present invention is shown in FIG. 5 where the weave 38 is layered within the elastomeric material 36. This embodiment is preferably manufactured by impregnating the weave 38 with the elastomeric material 36 and then compression molding a sufficient amount of the elastomeric material 36 around the weave 38 to form a protective layer. The composite would then be vulcanized to form a continuous, homogeneous bag 22.

To illustrate the improved tear resistance of the present invention, tests were conducted using a conventional elastomeric bag and four elastomeric bags made using differing formulas but the identical method as disclosed above in relation to FIG. 2. The results of the tests are shown in Attachment 1, and show an increase in the compound tear strength at 200 degrees C. of up to about 3 times the previous tear strength. The tests also indicated a preferred amount of the particles and/or threads of about 1.0 to about 10.0 parts of reinforcing material per 100 parts of the elastomeric material, with the most preferred amount being about 5.0 parts of reinforcing material per 100 parts of the elastomeric material.

Whereas the present invention has been described in particular relation to the drawings attached hereto, it should be understood that other and further modifications, apart from those shown or suggested herein, may be made within the scope and spirit of the present invention.

What is claimed is:

1. A reinforced elastomeric motor protector bag comprising a bag body formed from:

(a) elastomeric material selected from the group consisting essentially of: tetrafluoroethylene-propylene copolymer, vinylidene fluoride hexafluoropropylene copolymer, virtually saturated acrylonitrile-butadiene copolymer, vinylidene fluoride-perfluoromethylvinylether-tetrafluoroethylene terpolymer, vinylidene fluoride hexafluoropropylene tetrafluoroethylene terpolymer, ethylene propylene diene methylene-based polymers, and combinations thereof; and (b) a reinforcing material selected from the group consisting essentially of:

tetrafluroethylene, aromatic p-polyamides, aromatic o,m-polyamides, fiberglass, ferrous metal, nonferrous metal, and combinations thereof.

2. A reinforced elastomeric motor protector bag of claim 1 wherein the bag body is formed as a single continuous structure.

3. A reinforced elastomeric motor protector bag of claim 1 wherein the reinforcing material is in the form of particles.

4. A reinforced elastomeric motor protector bag of claim 1 wherein the reinforcing material is in the form of threads.

5. A reinforced elastomeric motor protector bag of claim 1 wherein the reinforcing material is in the form of a weave.

6. A reinforced elastomeric motor protector bag of claim 1 wherein the reinforcing material is dispersed within the elastomeric material in a manner to improve the tear resistance of the elastomeric material.

7. A reinforced elastomeric motor protector bag of claim 1 wherein the reinforcing material is bonded to the elastomeric material in a manner to improve the tear resistance of the elastomeric material.

8. A reinforced elastomeric motor protector bag of claim 5 wherein the reinforcing material is layered within the elastomeric material in a manner to improve the tear resistance of the elastomeric material.

9. A reinforced elastomeric motor protector bag of claim 5 wherein the reinforcing material is bonded to the elastomeric material in a manner to improve the tear resistance of the elastomeric material.

10. An elastomeric motor protector bag comprising:

a bag body made of an elastomeric material and being reinforced by a plurality of discontinuous reinforcing elements.

11. The motor protector bag, as set forth in claim 10, wherein the plurality of discontinuous reinforcing elements comprise a plurality of particles.

12. The motor protector bag, as set forth in claim 10, wherein the plurality of discontinuous reinforcing elements comprise a plurality of threads.

13. The motor protector bag, as set forth in claim 10, wherein the plurality of discontinuous reinforcing elements are dispersed within the elastomeric material.

14. The motor protector bag, as set forth in claim 10, wherein the plurality of discontinuous reinforcing elements are bonded to a surface of the elastomeric material.

15. The motor protector bag, as set forth in claim 10, wherein the plurality of discontinuous reinforcing elements are layered within the elastomeric material.

16. The motor protector bag, as set forth in claim 10, wherein the plurality of discontinuous reinforcing elements are layered between adjacent layers of the elastomeric material.

17. The motor protector bag, as set forth in claim 10, wherein the elastomeric material comprises at least one of tetrafluoroethylene-propylene copolymer, vinylidene fluoride hexafluoropropylene copolymer, virtually saturated acrylonitrile-butadiene copolymer, vinylidene fluoride-perfluoromethylvinylether-tetrafluoroethylene terpolymer, vinylidene fluoride hexafluoropropylene tetrafluoroethylene terpolymer, and ethylene propylene diene methylene-based polymers.

18. The motor protector bag, as set forth in claim 10, wherein the reinforcing elements comprise at least one of tetrafluroethylene, aromatic p-polyamides, aromatic o,m-polyamides, fiberglass, ferrous metal, and nonferrous metal.

* * * * *